US009051753B1

(12) United States Patent
Zamirpour

(10) Patent No.: US 9,051,753 B1
(45) Date of Patent: Jun. 9, 2015

(54) TREE MOUNTED SHELTER ASSEMBLY

(71) Applicant: Payman Zamirpour, Baytown, TX (US)

(72) Inventor: Payman Zamirpour, Baytown, TX (US)

( * ) Notice: Subject to any disclaimer, the term of this patent is extended or adjusted under 35 U.S.C. 154(b) by 0 days.

(21) Appl. No.: 14/132,255

(22) Filed: Dec. 18, 2013

(51) Int. Cl.
*E04H 15/04* (2006.01)
*E04H 15/26* (2006.01)
*E04H 15/58* (2006.01)

(52) U.S. Cl.
CPC ..... *E04H 15/04* (2013.01); *E04H 15/26* (2013.01); *E04H 15/58* (2013.01)

(58) Field of Classification Search
USPC ..... 135/90, 99; 47/32.5; 56/329
See application file for complete search history.

(56) References Cited

U.S. PATENT DOCUMENTS

| | | | | | |
|---|---|---|---|---|---|
| 5,156 | A * | 6/1847 | Collyer | 56/329 |
| 219,987 | A * | 9/1879 | Scott et al. | 47/32.4 |
| 853,833 | A * | 5/1907 | Saum, Jr. | 56/329 |
| 1,286,980 | A * | 12/1918 | Fleckner | 56/329 |
| 1,536,167 | A * | 5/1925 | Totten | 56/329 |
| 2,263,867 | A * | 11/1941 | Barnard | 135/90 |
| 2,649,680 | A * | 8/1953 | Brown | 56/329 |
| 3,783,906 | A * | 1/1974 | Matherne | 138/103 |
| 4,458,707 | A * | 7/1984 | Lindaman | 135/90 |
| 4,505,286 | A | 3/1985 | Madion | |
| 4,739,785 | A | 4/1988 | Poulson | |
| 4,836,232 | A | 6/1989 | De Rosa et al. | |
| 4,901,513 | A * | 2/1990 | Kim et al. | 56/329 |
| 5,259,408 | A * | 11/1993 | Guerin | 135/90 |
| 5,538,523 | A | 7/1996 | Benetti | |
| 5,787,914 | A | 8/1998 | Greywall | |
| D461,429 | S | 8/2002 | Holland | |
| 7,264,011 | B2 | 9/2007 | Cohen | |
| 7,290,552 | B1 | 11/2007 | Eisbrenner | |
| 7,431,041 | B2 * | 10/2008 | Wu | 135/21 |
| D604,428 | S | 11/2009 | Waters | |
| 2005/0158507 | A1 * | 7/2005 | Nelson | 428/66.6 |
| 2007/0144570 | A1 * | 6/2007 | Cooper | 135/90 |

* cited by examiner

*Primary Examiner* — Noah Chandlerhawk

(57) ABSTRACT

A tree mounted shelter assembly secures a shelter to a tree to prevent damage to an object under the tree due to material falling from the tree. The assembly includes a tarp having an interior edge and an exterior edge. The interior edge defines an aperture through the tarp configured for encircling a trunk of a tree. Each of a plurality of lines has a first end coupled to the tarp and a second end configured for coupling to the tree wherein the tarp is suspended under limbs of the tree.

9 Claims, 4 Drawing Sheets

TREE MOUNTED SHELTER ASSEMBLY

BACKGROUND OF THE DISCLOSURE

Field of the Disclosure

The disclosure relates to shelter devices and more particularly pertains to a new shelter device for securing a shelter to a tree to prevent damage to an object under the tree due to material falling from the tree.

SUMMARY OF THE DISCLOSURE

An embodiment of the disclosure meets the needs presented above by generally comprising a tarp having an interior edge and an exterior edge. The interior edge defines an aperture through the tarp configured for encircling a trunk of a tree. Each of a plurality of lines has a first end coupled to the tarp and a second end configured for coupling to the tree wherein the tarp is suspended under limbs of the tree.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
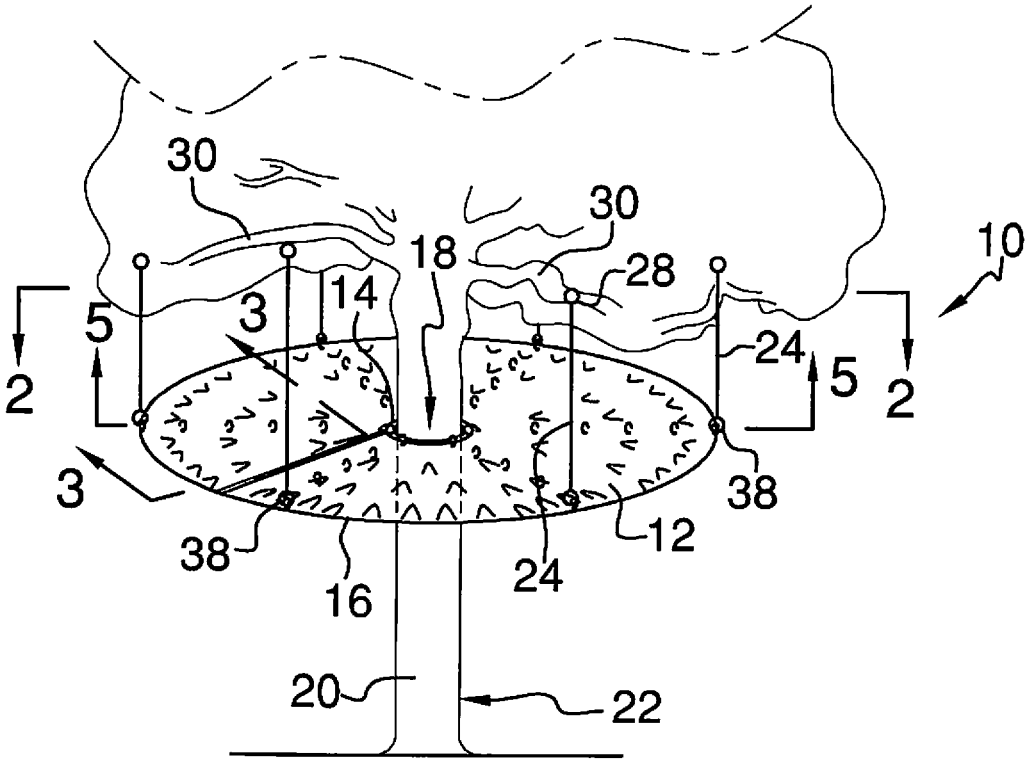
FIG. 1 is a top front side view of a tree mounted shelter assembly according to an embodiment of the disclosure.
Figure 2:
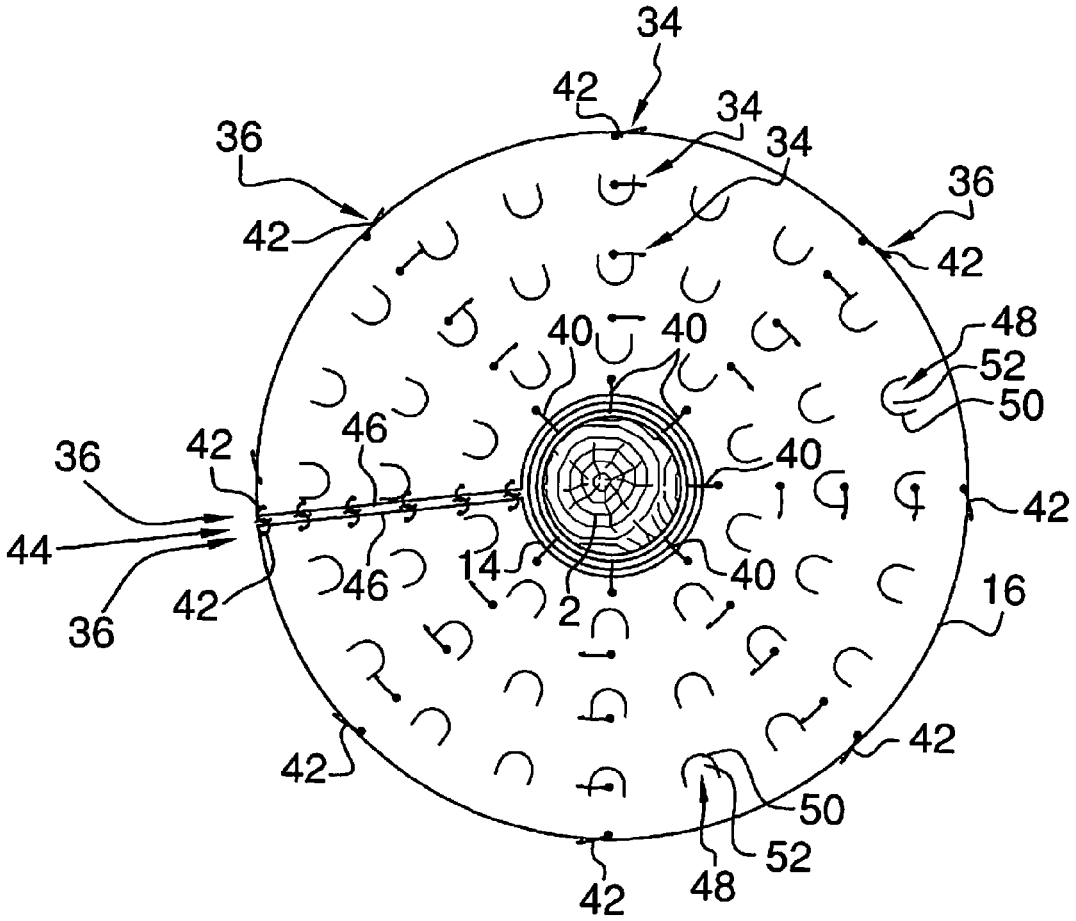
FIG. 2 is a cross-sectional view of an embodiment of the disclosure taken along line 2-2 of FIG. 1.

With reference now to the drawings, and in particular to FIGS. 1 through 6 thereof, a new shelter device embodying the principles and concepts of an embodiment of the disclosure and generally designated by the reference numeral 10 will be described.

As best illustrated in FIGS. 1 through 6, the tree mounted shelter assembly 10 generally comprises a tarp 12 having an interior edge 14 and an exterior edge 16. The interior edge 14 defines an aperture 18 through the tarp 12 configured for encircling a trunk 20 of a tree 22. The aperture 18 may be round and centrally positioned in the tarp 12. A plurality of lines 24 is provided. Each line 24 has a first end 26 coupled to the tarp 12 and a second end 28 configured for coupling to the tree 22 wherein the tarp 12 is suspended under limbs 30 of the tree 22. The second end 28 of each line 24 may be tied or comprise a hook, clip, or other structure to facilitate attachment of the line 24 to the limbs 30 of the tree 22.

A cord 32 may be coupled to the interior edge 14 of the tarp 12. The cord 32 is configured for coupling the interior edge 14 of the tarp 12 around the trunk 20 of the tree 22. A plurality of hooks 34 is coupled to the tarp 12. Each hook 34 may be a clip, carabiner, clasp, or the like. The first end 26 of each line 24 is couplable to a selectable one of the hooks 34. The hooks 34 may be arranged into a plurality of rows 36 and each row 36 of the hooks 34 may extend radially outward from the interior edge 14 to the exterior edge 16 of the tarp 12. Each line 24 may be tied to the hooks 34 or a plurality of loops 38 may be utilized. Each loop 38 is coupled to the first end 26 of an associated one of the lines 24 such that the selected hook 34 may be inserted through the loop 38 to engage the first end 26 of the line 24 to the hook 34.

A plurality of inner edge hooks 40 may be a part of the plurality of hooks 34. Each inner edge hook 40 is coupled to the tarp 12 along the interior edge 14 of the tarp 12 and may be used to engage the cord 32 to hold the interior edge 14 of the tarp 12 against the trunk 20 of the tree 22. A plurality of outer edge hooks 42 may comprise a portion of the plurality of hooks 34. Each outer edge hook 42 is coupled to the tarp 12 along the exterior edge 16 of the tarp 12. The lines 24 may be coupled to the outer edge hooks 42 for full coverage of the tarp 12 or the lines 24 may be coupled to other ones of the hooks 34 positioned between the inner edge hooks 40 and the outer edge hooks 42. When the lines 24 are coupled to a hook 34 offset from the exterior edge 16 of the tarp 12, the tarp 12 may be folded or an outer portion of the tarp 12 may be allowed to hang down if so desired.

Figure 3:
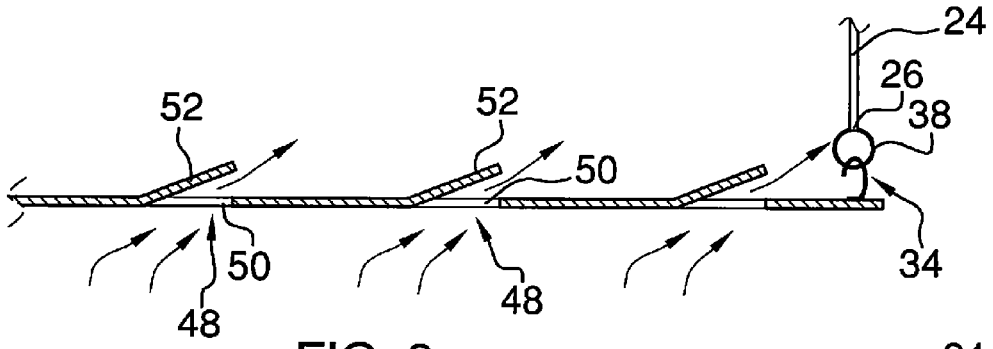
FIG. 3 is a cross-sectional view of an embodiment of the disclosure taken along line 3-3 of FIG. 1 when wind is present.
Figure 4:
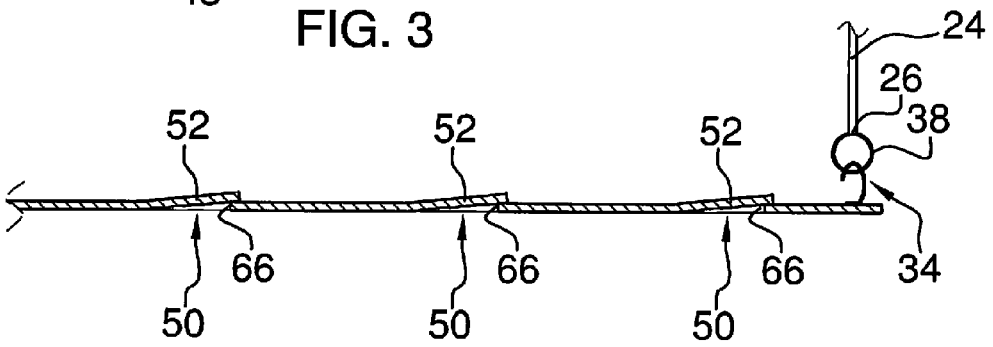
FIG. 4 is a cross-sectional view of an embodiment of the disclosure similar to FIG. 3 when wind is not present.
Figure 5:
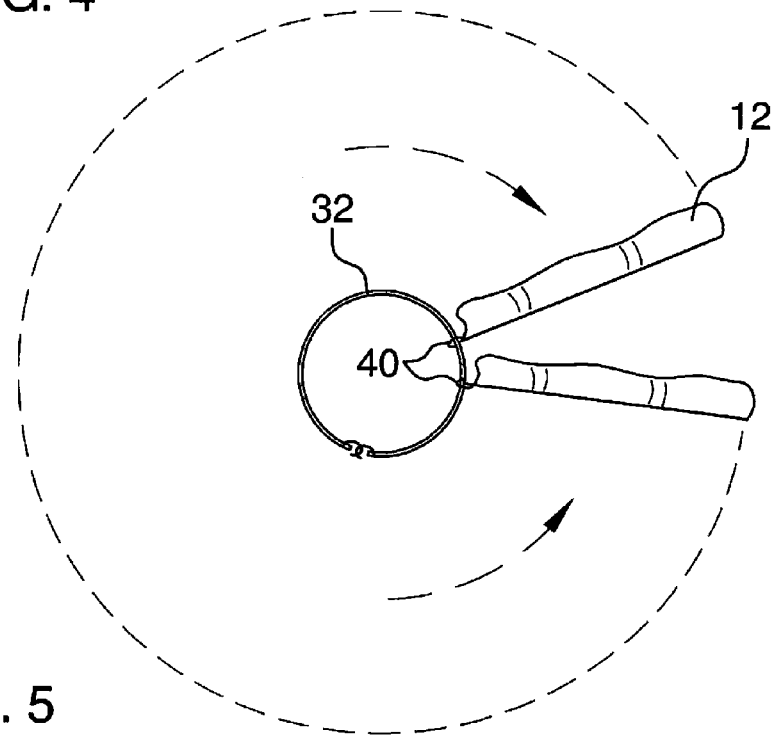
FIG. 5 is a top view of an embodiment of the disclosure.
Figure 6:
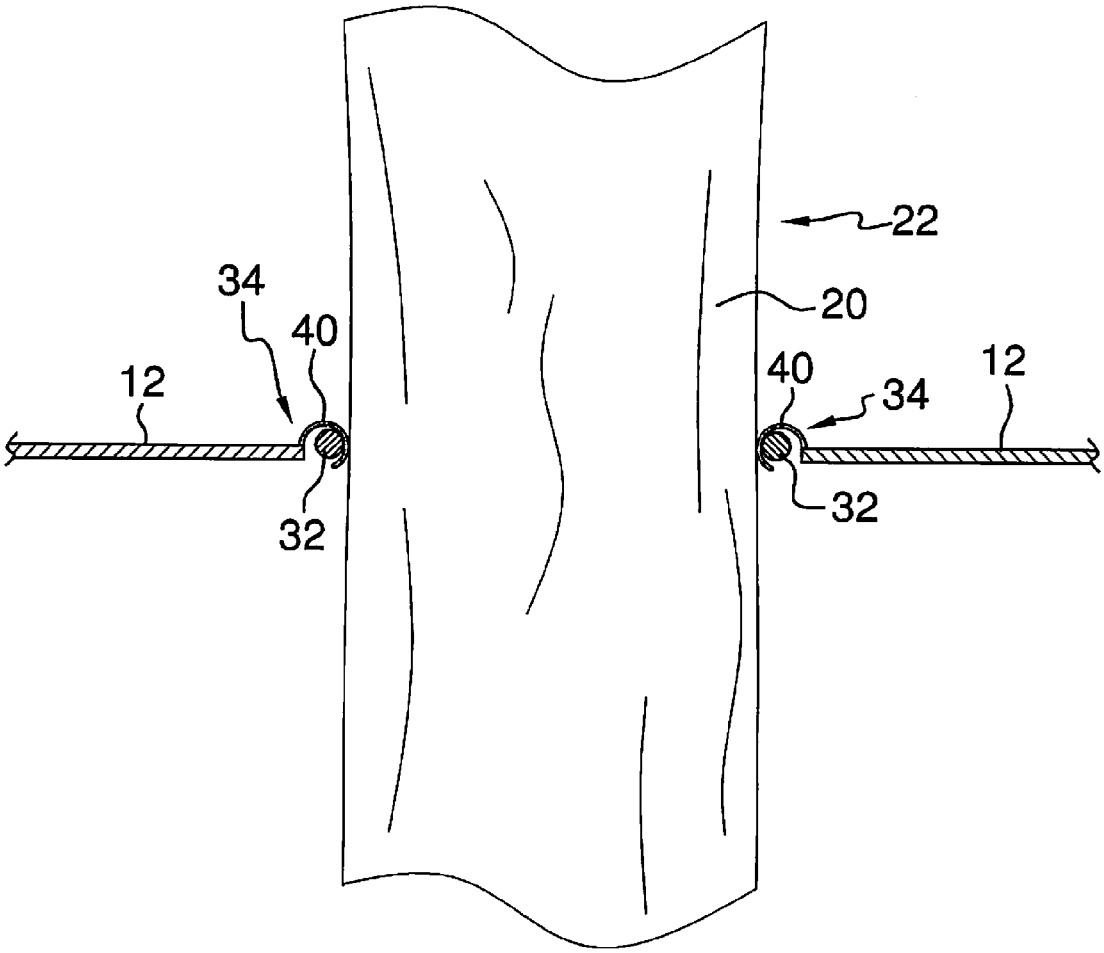
FIG. 6 is a cross-sectional view of an embodiment of the disclosure taken along line 5-5 of FIG. 1.

A linear slit 44 extends between the interior edge 14 and the exterior edge 16 of the tarp 12 facilitating installation of the tarp 12 around the trunk 20 of the tree 22. The linear slit 44 defines a pair of end edges 46 of the tarp 12. The end edges 46 may be folded or rolled to provide for the tarp 12 to extend only partially around the tree 22 if so desired. A plurality of vents 48 extends through the tarp 12. Each vent 48 may be defined by a curved slit 50 extending through the tarp 12. The curved slit 50 may be substantially U-shaped. Each curved slit 50 defines an associated flap 52 such that the tarp 12 remains a substantially constant surface to prevent objects from passing through the tarp 12 where they might damage an object below such as a parked car. As shown in FIG. 4, each flap 52 may overlap an edge 66 of the slit 50 to facilitate prevention of objects from passing through the slit 50. As shown in FIG. 3, the vents 48 provide for air to pass through the vents 48 during strong winds to prevent the wind from detaching the tarp 12 from the tree 22 or blowing the tarp 12 out of the desired position.

In use, the tarp 12 is positioned around the tree 22 as desired. The lines 24 are attached between the limbs 30 of the tree 22 to suspend the tarp 12 at a desired height providing shelter from sunlight, sap, pollen, leaves, or other debris which may fall from the tree 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A tree mounted shelter assembly comprising:

a tarp having an interior edge and an exterior edge, said interior edge defining an aperture through said tarp configured for encircling a trunk of a tree;

a plurality of lines, each line having a first end coupled to said tarp and a second end configured for coupling to the tree wherein said tarp is suspended under limbs of the tree; and a plurality of hooks coupled to said tarp, said first end of each said line being couplable to a selectable one of said hooks, said hooks being arranged into a plurality of rows, each said row including at least three said hooks, each said row of said hooks extending radially outward from said interior edge to said exterior edge.

2. The assembly of claim 1, further comprising a cord coupled to said interior edge of said tarp, said cord being configured for coupling said interior edge of said tarp around the trunk of the tree.

3. The assembly of claim 1, further comprising a plurality of loops, each loop being coupled to said first end of an associated one of said lines.

4. The assembly of claim 1, further comprising said plurality of hooks further comprising a plurality of inner edge hooks, each said inner edge hook being coupled to said tarp along said interior edge of said tarp.

5. The assembly of claim 1, further comprising said plurality of hooks further comprising a plurality of outer edge hooks, each said outer edge hook being coupled to said tarp along said exterior edge of said tarp.

6. The assembly of claim 1, further comprising a linear slit extending between said interior edge and said exterior edge of said tarp, said linear slit defining a pair of end edges of said tarp.

7. The assembly of claim 1, further comprising a plurality of vents extending through said tarp.

8. The assembly of claim 7, further comprising each said vent being defined by a curved slit extending through said tarp, each curved slit defining an associated flap.

9. A tree mounted shelter assembly comprising:

a tarp having an interior edge and an exterior edge, said interior edge defining an aperture through said tarp configured for encircling a trunk of a tree;

a plurality of lines, each line having a first end coupled to said tarp and a second end configured for coupling to the tree wherein said tarp is suspended under limbs of the tree;

a cord coupled to said interior edge of said tarp, said cord being configured for coupling said interior edge of said tarp around the trunk of the tree;

a plurality of hooks coupled to said tarp, said first end of each said line being couplable to a selectable one of said hooks, said hooks being arranged into a plurality of rows, each said row including at least three said hooks, each said row of said hooks extending radially outward from said interior edge to said exterior edge;

a plurality of loops, each loop being coupled to said first end of an associated one of said lines;

a plurality of inner edge hooks of said plurality of hooks, each said inner edge hook being coupled to said tarp along said interior edge of said tarp;

a plurality of outer edge hooks of said plurality of hooks, each said outer edge hook being coupled to said tarp along said exterior edge of said tarp;

a linear slit extending between said interior edge and said exterior edge of said tarp, said linear slit defining a pair of end edges of said tarp; and a plurality of vents extending through said tarp, each said vent being defined by a curved slit extending through said tarp, each curved slit defining an associated flap.

* * * * *